US010101696B2

(12) United States Patent
Kanou

(10) Patent No.: US 10,101,696 B2
(45) Date of Patent: Oct. 16, 2018

(54) FIXING APPARATUS AND IMAGE FORMING APPARATUS

(71) Applicant: KONICA MINOLTA, INC., Chiyoda-ku, Tokyo (JP)

(72) Inventor: Hirotaka Kanou, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/872,219

(22) Filed: Jan. 16, 2018

(65) Prior Publication Data

US 2018/0267444 A1 Sep. 20, 2018

(30) Foreign Application Priority Data

Mar. 16, 2017 (JP) ..... 2017-051160

(51) Int. Cl.
*G03G 15/20* (2006.01)

(52) U.S. Cl.
CPC ..... *G03G 15/2053* (2013.01); *G03G 15/2028* (2013.01)

(58) Field of Classification Search
CPC ..... G03G 15/2028; G03G 15/2053
See application file for complete search history.

(56) References Cited

U.S. PATENT DOCUMENTS 8,055,175 B2 * 11/2011 Sugaya ..... G03G 15/2032 399/329
8,867,943 B2 * 10/2014 Ishigaya ..... G03G 15/205 399/333
2014/0105658 A1 * 4/2014 Tamaki ..... G03G 15/2032 399/329

FOREIGN PATENT DOCUMENTS

JP 2011053452 A 3/2011
JP 2014163958 A 9/2014
JP 2016024367 A 2/2016

* cited by examiner

*Primary Examiner* — Gregory H Curran
(74) *Attorney, Agent, or Firm* — Holtz, Holtz & Volek PC

(57) ABSTRACT

A fixing apparatus includes a heating rotator which generates heat with an induced current, an excitation coil arranged outside the heating rotator, a pressure roller which rotates with paper being held between the pressure roller and the heating rotator, the paper having a toner image developed thereon, and a relative position changer which changes a relative position of the excitation coil and the heating rotator to a first relative position when the toner image is being fixed to the paper and to a second relative position when the toner image is not being fixed to the paper. In a cross-section perpendicular to a rotation axis of the heating rotator, a distance from a point in an outer circumferential surface of the heating rotator closest to the pressure roller to the excitation coil is shorter at the second relative position than at the first relative position.

15 Claims, 15 Drawing Sheets

FIXING APPARATUS AND IMAGE FORMING APPARATUS

The entire disclosure of Japanese Patent Application No. 2017-051160, filed on Mar. 16, 2017, is incorporated herein by reference in its entirety.

BACKGROUND

Technological Field

The present disclosure relates to a fixing apparatus of an induction heating type and an image forming apparatus including the same.

Description of the Related Art

An image forming apparatus such as a copying machine includes a fixing apparatus for fixing a toner image transferred to paper onto the paper. An induction heating fixing apparatus including a heating rotator which melts toner, a pressure roller which presses paper by being brought in pressure contact with the heating rotator, and an excitation coil which heats the heating rotator has been known as the fixing apparatus.

For example, Japanese Laid-Open Patent Publications Nos. 2011-53452 and 2016-24367 disclose a fixing apparatus in which an excitation coil is arranged inside a heating rotator.

With arrangement of an excitation coil inside a heating rotator, however, when the timing to replace the heating rotator comes, the excitation coil is also simultaneously replaced together with the heating rotator, which increases cost.

Japanese Laid-Open Patent Publication No 2014-163958 discloses a fixing apparatus in which an excitation coil is arranged outside a heating rotator. Thus, even in replacement of the heating rotator, it is not necessary to replace the excitation coil.

FIG. 15 is a cross-sectional view showing a conventional example of a fixing apparatus in which an excitation coil is arranged outside a heating rotator. As shown in FIG. 15, the fixing apparatus includes a heating rotator 511, a pressure roller 510, a magnetic flux generator 512, a temperature sensor 525, and a high-frequency power supply circuit 519.

High-frequency power supply circuit 519 feeds a current in accordance with a temperature sensed by temperature sensor 525 to an excitation coil 522 of magnetic flux generator 512. Magnetic fluxes generated by excitation coil 522 induce an eddy current in heating rotator 511 made of a metal so that Joule heat is generated. Heating rotator 511 is thus inductively heated. Heating rotator 511 rotates as following rotation of pressure roller 510. Paper P is transported as being held between pressure roller 510 and heating rotator 511 and toner T on paper P is fixed to paper P.

SUMMARY

As shown in FIG. 15, when magnetic flux generator 512 is arranged outside heating rotator 511, magnetic flux generator 512 is arranged not to interfere with a transportation path for paper P. Specifically, magnetic flux generator 512 is arranged opposite to pressure roller 510 with respect to heating rotator 511, and it locally heats a region covering substantially half an outer circumferential surface of heating rotator 511. Therefore, when magnetic flux generator 512 generates magnetic fluxes when heating rotator 511 is not rotating or rotating at a low speed, a temperature of heating rotator 511 is highly uneven. Therefore, when heating rotator 511 is preheated while paper P is not being transported as well, pressure roller 510 should be rotated and heating rotator 511 should rotate as following rotation of the pressure roller. Thus, even when printing is not being performed, disadvantageously, operation noise due to rotation of pressure roller 510 and heating rotator 511 is generated and power consumed for rotational drive of pressure roller 510 is high.

The present disclosure was made to solve the problems as described above, and an object in one aspect is to provide a fixing apparatus and an image forming apparatus which can achieve suppressed unevenness in temperature in induction heating of a heating rotator even when the heating rotator is not rotating or rotating at a low speed.

To achieve at least one of the abovementioned objects, according to an aspect of the present disclosure, a fixing apparatus reflecting one aspect of the present disclosure comprises a heating rotator which generates heat with an induced current, an excitation coil arranged outside the heating rotator, a pressure roller which rotates with paper being held between the pressure roller and the heating rotator, the paper having a toner image developed thereon, and a relative position changer which changes a relative position of the excitation coil and the heating rotator to a first relative position when the toner image is being fixed to the paper and to a second relative position when the toner image is not being fixed to the paper. In a cross-section perpendicular to a rotation axis of the heating rotator, a distance from a point closest to the pressure roller in an outer circumferential surface of the heating rotator to the excitation coil is shorter at the second relative position than at the first relative position.

The foregoing and other objects, features, aspects and advantages of the present invention will become more apparent from the following detailed description of the present invention when taken in conjunction with the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
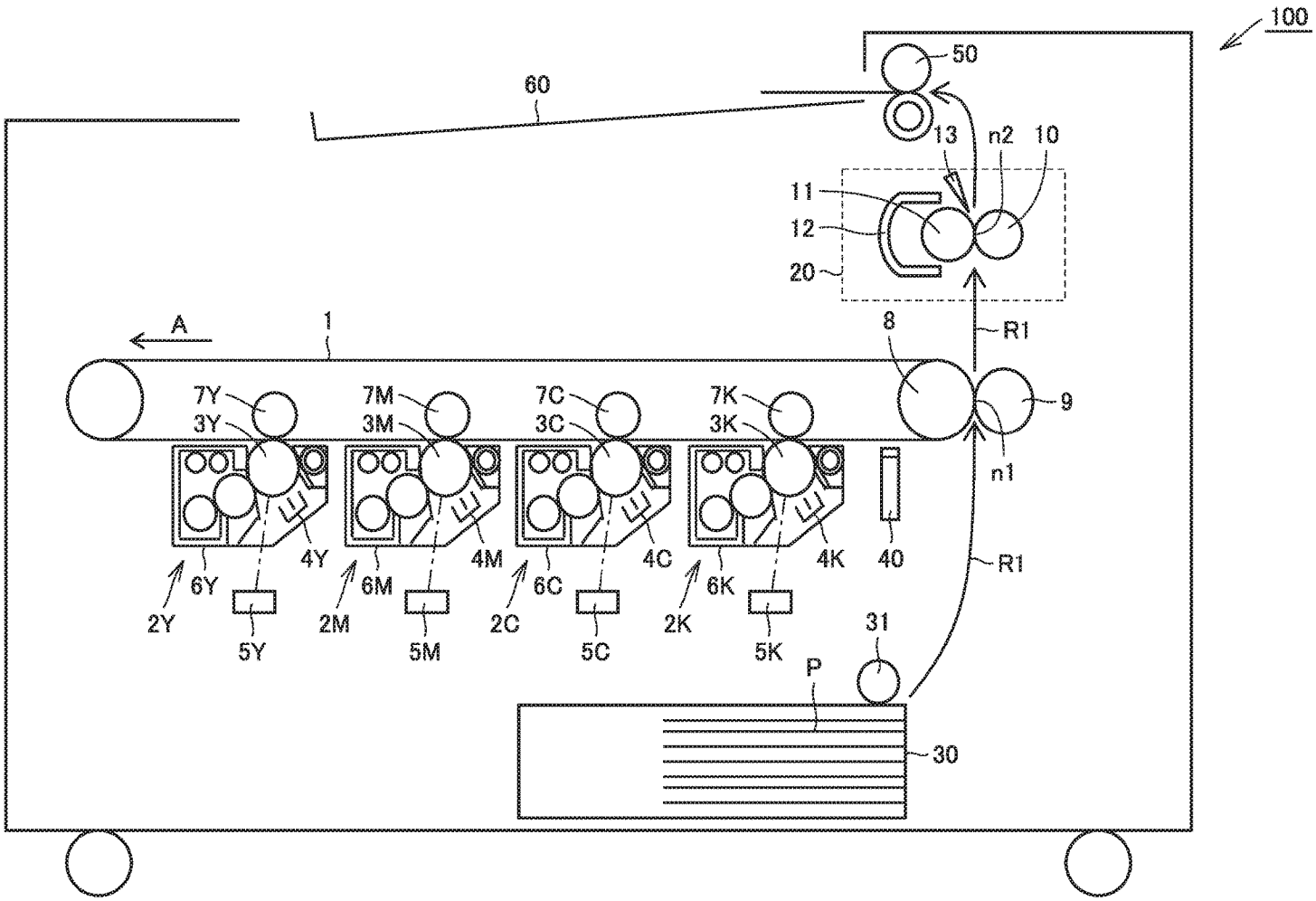
FIG. 1 is a cross-sectional view showing an internal configuration of an image forming apparatus according to a first embodiment.

Hereinafter, one or more embodiments of the present invention will be described with reference to the drawings. However, the scope of the invention is not limited to the disclosed embodiments.

Each embodiment according to the present invention will be described below with reference to the drawings. In the description below, the same elements and components have the same reference characters allotted. Their labels and functions are also the same. Therefore, detailed description thereof will not be repeated. Each embodiment and each modification described below may selectively be combined as appropriate.

First Embodiment (Internal Configuration of Image Forming Apparatus)

FIG. 1 is a cross-sectional view showing an internal configuration of an image forming apparatus 100 in a first embodiment. Image forming apparatus 100 includes an intermediate transfer belt 1 as a belt member substantially in a central portion of the inside. Four imaging units 2Y, 2M, 2C, and 2K corresponding to colors of yellow (Y), magenta (M), cyan (C), and black (K), respectively, are arranged as being aligned along intermediate transfer belt 1 under a lower horizontal portion of intermediate transfer belt 1 and have photoconductor drums 3Y. 3M, 3C, and 3K, respectively.

Chargers 4Y, 4M, 4C, and 4K, print head portions 5Y, 5M, 5C, and 5K, developing devices 6Y, 6M, 6C, and 6K, and primary transfer rollers 7Y, 7M, 7C, and 7K opposed to photoconductor drums 3Y, 3M, 3C, and 3K with intermediate transfer belt 1 being interposed are arranged sequentially around photoconductor drums 3Y, 3M, 3C, and 3K along a direction of rotation thereof, respectively.

A secondary transfer roller 9 is brought in pressure contact with a portion of intermediate transfer belt 1 supported by an intermediate transfer belt drive roller 8, and a nip portion between secondary transfer roller 9 and intermediate transfer belt 1 is defined as a secondary transfer region n1. A fixing apparatus 20 including a pressure roller 10, a heating rotator 11, a magnetic flux generator 12, and a separation member 13 is arranged at a downstream position in a transportation path R1 subsequently to secondary transfer region n1. A portion of pressure contact between pressure roller 10 and heating rotator 11 is defined as a fixing nip region n2.

A paper feed cassette 30 is removably arranged in a lower portion of image forming apparatus 100. Paper P loaded and accommodated in paper feed cassette 30 is sent to transportation path R1 one by one from a sheet of paper at the top as a paper feed roller 31 rotates. An auto image density control (AIDC) sensor 40 which also serves as a registration sensor is provided between imaging unit 2K on the most downstream side of intermediate transfer belt 1 and secondary transfer region n1. A paper ejection roller 50 is provided downstream from fixing apparatus 20 in transportation path R1. A paper ejection tray 60 is formed on an upper surface of image forming apparatus 100.

(Schematic Operation of Image Forming Apparatus)

A schematic operation of image forming apparatus 100 will now be described. When an image signal is input to an image signal processing unit (not shown) of image forming apparatus 100 from an external apparatus (such as a personal computer), the image signal processing unit generates digital image signals obtained by conversion of this image signal into signals of colors of yellow, cyan, magenta, and black and has print head portions 5Y, 5M, 5C, and 5K of respective imaging units 2Y, 2M, 2C, and 2K emit light based on the digital image signals for exposure.

Electrostatic latent images formed on respective photoconductor drums 3Y, 3M, 3C, and 3K are thus developed by respective developing devices 6Y, 6M, 6C, and 6K to become toner images of respective colors. The toner images of these colors are primarily transferred onto intermediate transfer belt 1 which moves in a direction shown with an arrow A in FIG. 1 as being successively superimposed on one another as a result of functions of primary transfer rollers 7Y, 7M, 7C, and 7K.

The toner image thus formed on intermediate transfer belt 1 reaches secondary transfer region n1 with movement of intermediate transfer belt 1. Toner images of respective colors superimposed on one another in secondary transfer region n1 are secondarily collectively transferred onto paper P as a result of a function of secondary transfer roller 9.

Paper P to which the toner image has secondarily been transferred reaches fixing nip region n2 in fixing apparatus 20 controlled such that a surface temperature of heating rotator 11 is within a range of prescribed fixing temperatures. The surface of paper P where the toner image has been formed (an unfixed toner image carrying surface) comes in contact with heating rotator 11. Paper P introduced into fixing nip region n2 is transported as being held. In fixing nip region n2, the unfixed toner image is molten and fixed to paper P as a result of a function of pressure roller 10 and heating rotator 11 which inductively generates heat owing to magnetic flux generator 12. Paper P to which the toner image has been fixed is ejected to paper ejection tray 60 as paper ejection roller 50 rotates.

(Configuration of Fixing Apparatus)

Figure 2:
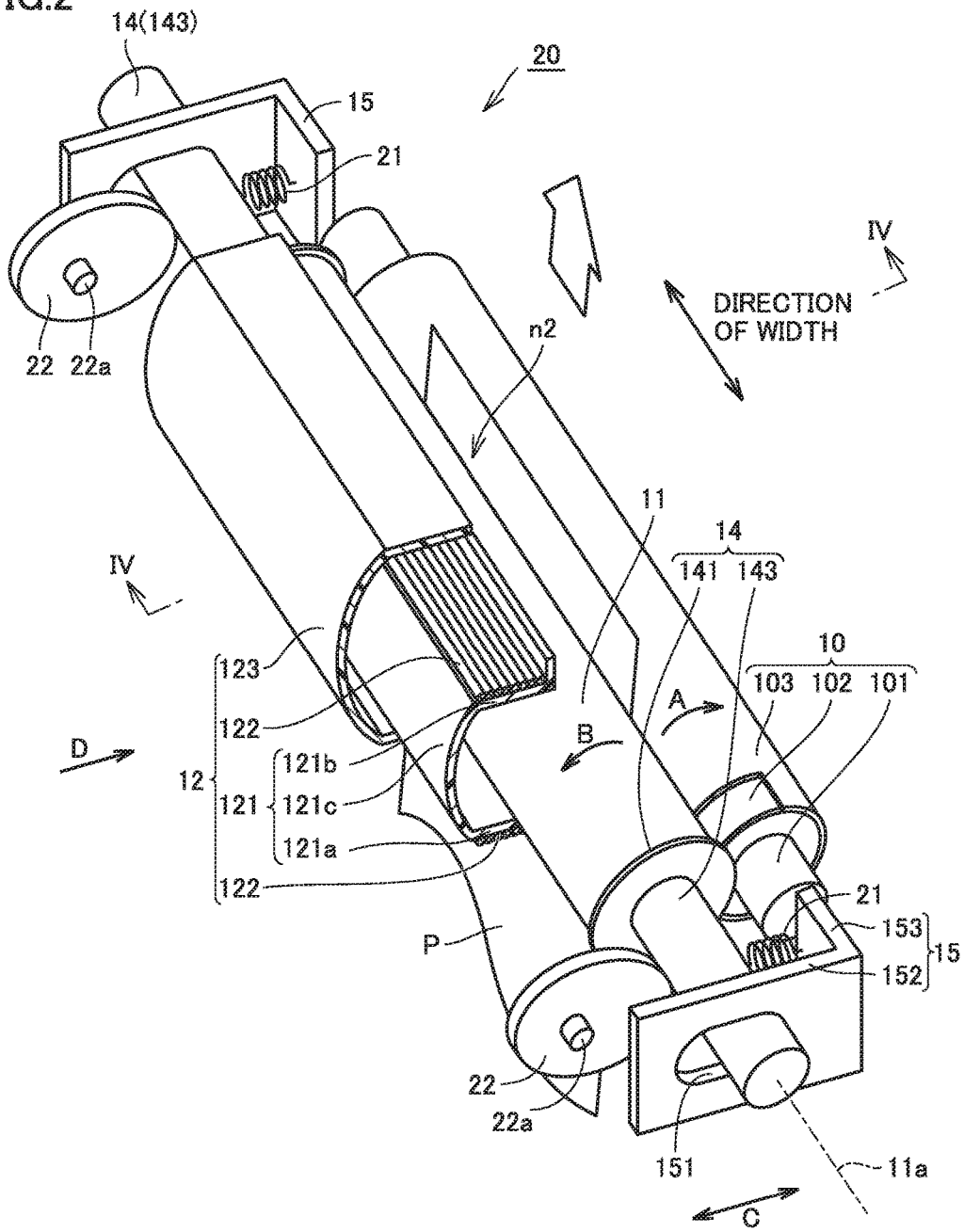
FIG. 2 is a partially cut-away perspective view showing a configuration of a fixing apparatus according to the first embodiment.
Figure 3:
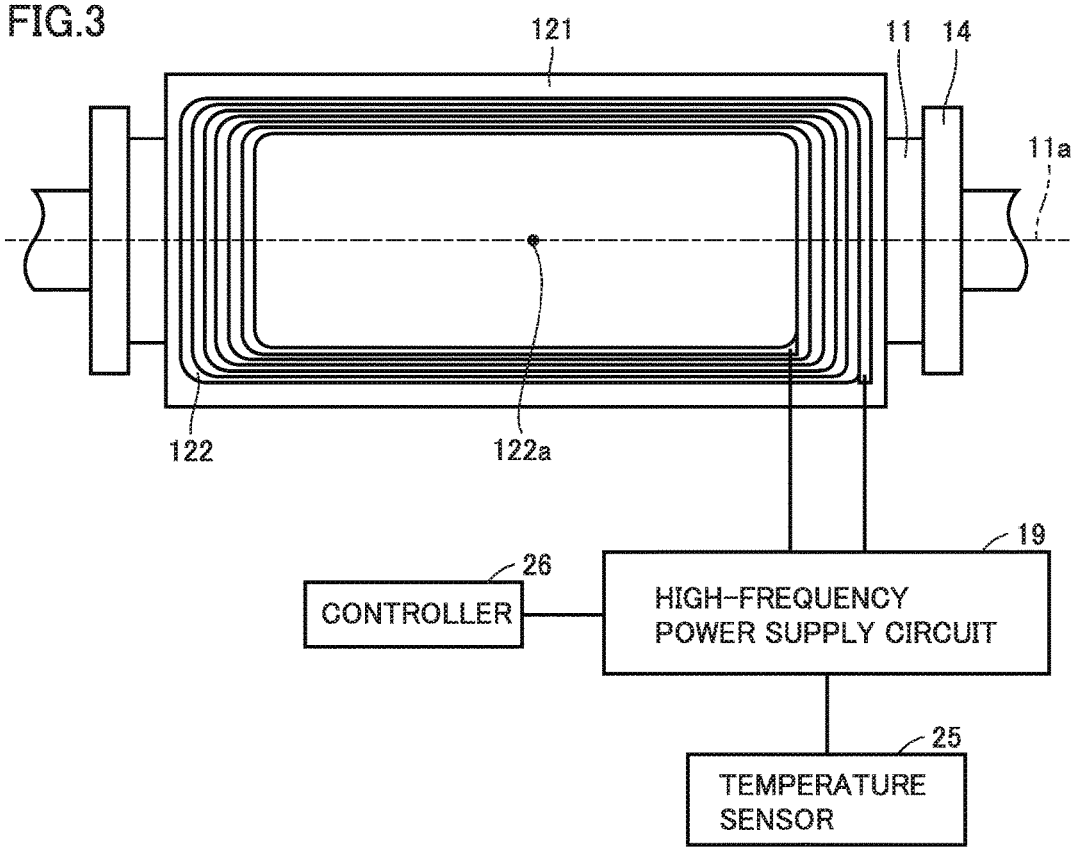
FIG. 3 is a side view of the fixing apparatus when viewed in a direction shown with an arrow D in FIG. 2.
Figure 4:
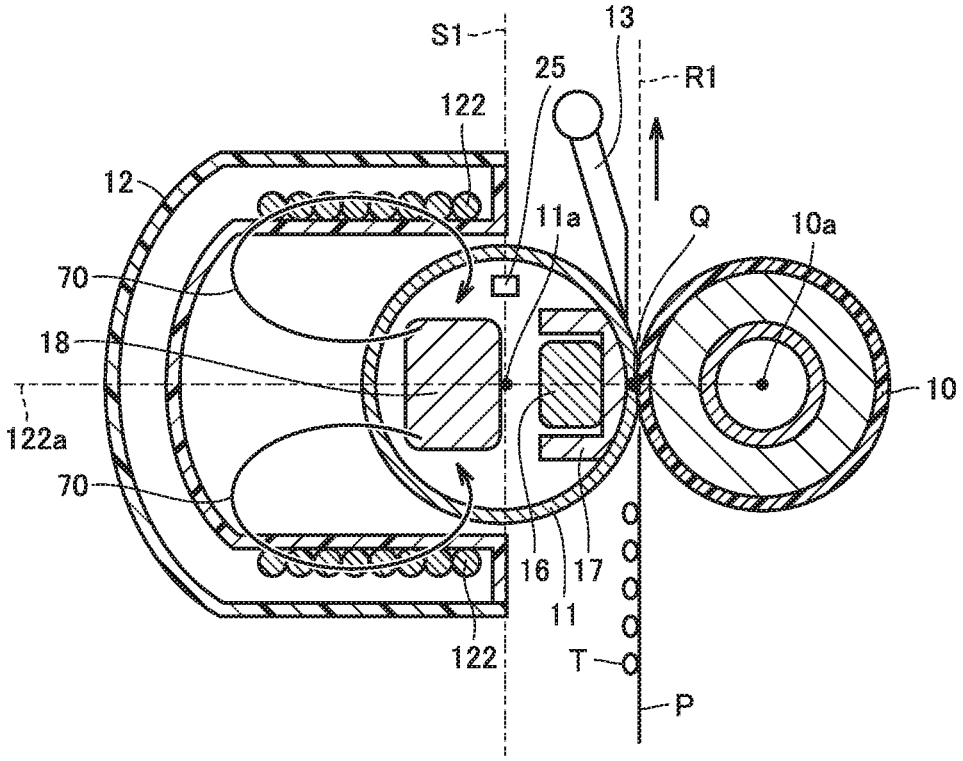
FIG. 4 is a cross-sectional view along the line IV-IV in FIG. 2.
Figure 5:
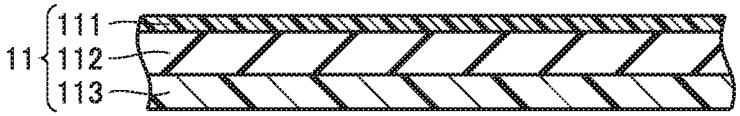
FIG. 5 is a cross-sectional view of a heating rotator.
Figure 6A:
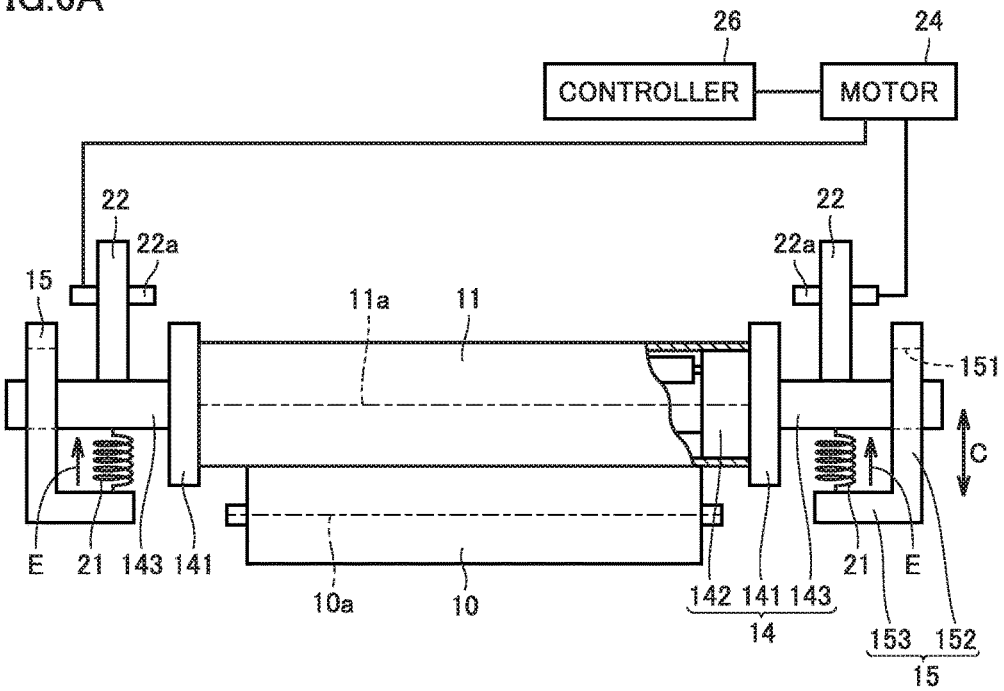
FIG. 6A is a plan view showing a configuration of the fixing apparatus according to the first embodiment.
Figure 6B:
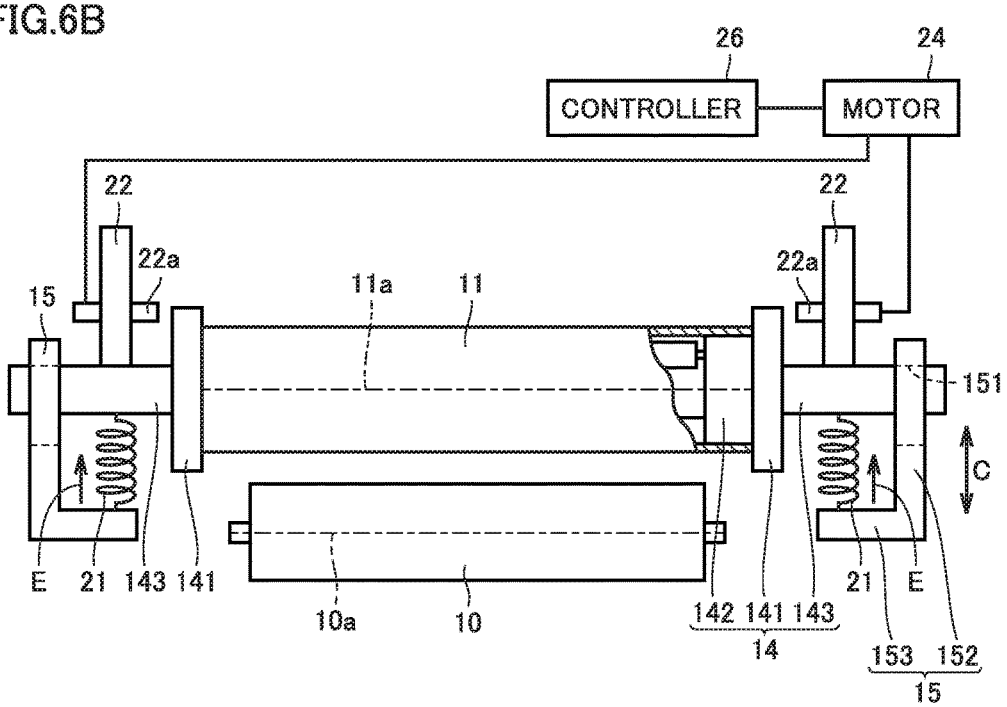
FIG. 6B is a plan view showing the configuration of the fixing apparatus when an eccentric cam rotates by 180 degrees from a position in FIG. 6A.

A configuration of fixing apparatus 20 will now be described with reference to FIGS. 2 to 6B. FIG. 2 is a partially cut-away perspective view showing the configuration of fixing apparatus 20. FIG. 2 shows a state that pressure roller 10 and magnetic flux generator 12 are partially cut away. FIG. 2 does not show separation member 13. FIG. 3 is a side view of fixing apparatus 20 when viewed in a direction shown with an arrow D in FIG. 2. FIG. 3 does not show a cover 123 (see FIG. 2) of magnetic flux generator 12. FIG. 4 is a cross-sectional view along the line IV-IV in FIG. 2. FIG. 5 is a cross-sectional view of heating rotator 11. FIGS. 6A and 6B are plan views showing the configuration of fixing apparatus 20. FIGS. 6A and 6B do not show magnetic flux generator 12.

Fixing apparatus 20 includes pressure roller 10, heating rotator 11, magnetic flux generator 12, separation member 13, a pair of support members 14, 14, a pair of guide members 15, 15, a pressing member 16, a first magnetic core 17, a second magnetic core 18, a high-frequency power supply circuit 19, a pair of springs 21, 21, a pair of eccentric cams 22, 22, a motor 24, a temperature sensor 25, and a controller 26. The pair of guide members 15, 15, the pair of springs 21, 21, the pair of eccentric cams 22, 22, and motor 24 form a movement mechanism which moves heating rotator 11.

(Pressure Roller)

As shown in FIG. 2, pressure roller 10 includes a release layer 103 layered around an elongated columnar core 101 with an elastic layer 102 being interposed. Pressure roller 10 is biased in a direction of a rotation axis 11*a* of heating rotator 11 by a not-shown pressure mechanism including a spring or the like. Pressure roller 10 is in pressure contact with heating rotator 11 with prescribed pressing force and ensures fixing nip region n2 between the pressure roller and a surface of heating rotator 11.

Core 101 is composed of aluminum or the like, elastic layer 102 is composed of silicone sponge rubber or the like, and release layer 103 is made of PFA (a tetrafluoroethylene perfluoro(alkyl vinyl ether) copolymer), a PTFE (polytetrafluoroethylene) coating, or the like.

Pressure roller 10 has opposing axial end portions of core 101 rotatably supported by a not-shown frame with a bearing member being interposed Pressure roller 10 is rotationally driven at a prescribed process speed in a direction shown with an arrow A shown in FIG. 2 as driving force from a driving motor (not shown) is transmitted.

(Heating Rotator)

Heating rotator 11 is an endless belt. Heating rotator 11 is provided such that rotation axis 11*a* is in parallel to a rotation axis 10*a* (see FIG. 4) of pressure roller 10. Heating rotator 11 rotates as following rotation of pressure roller 10 in a direction shown with an arrow B in FIG. 2, owing to frictional force in fixing nip region n2.

As shown in FIG. 5, heating rotator 11 is constituted of a release layer 111, an elastic layer 112, and a heat generation layer 113 layered in this order with release layer 111 being located on a surface side. Release layer 111 is composed of PFA (a tetrafluoroethylene perfluoro(alkyl vinyl ether) copolymer) having a thickness, for example, of approximately 20 μm. Elastic layer 112 is composed of silicone rubber having a thickness, for example, of approximately 200 μm. Heat generation layer 113 is a layer obtained by layering copper on nickel and plating the layer further with nickel, and it has a thickness, for example, of approximately 10 μm. Heat generation layer 113 generates heat with magnetic fluxes issued from magnetic flux generator 12. Heating rotator 11 is not limited to those composed of these materials. For example, heat generation layer 113 may be a layer obtained by plating polyimide with copper or a layer made of an SUS substrate.

(Support Member)

Support members 14, 14 are provided at respective opposing ends of heating rotator 11 to rotatably support end portions of heating rotator 11. As shown in FIGS. 2, 6A, and 6B, support member 14 includes a disc portion 141, an insertion portion 142 (not shown in FIG. 2), and a slide shaft portion 143. Disc portion 141, insertion portion 142, and slide shaft portion 143 are integrally formed.

Disc portion 141 is arranged at the end portion of heating rotator 11 and has a diameter greater than an outer diameter of heating rotator 11. Thus, position displacement of paper P in a direction of width (an in-plane direction of paper P perpendicular to a direction of transportation) during rotation of heating rotator 11 can be restricted.

Insertion portion 142 is in a form of a column formed on a surface of disc portion 141 on a side of heating rotator 11 and inserted in heating rotator 11. A diameter of insertion portion 142 is slightly smaller than an inner diameter of heating rotator 11. Insertion portion 142 supports heating rotator 11 around the outer circumferential surface as being rotatable in a circumferential direction.

Slide shaft portion 143 is in a form of a columnar projection and formed on a surface of disc portion 141 opposite to heating rotator 11. Slide shaft portion 143 is supported by guide member 15 as being slidable along a direction shown with an arrow C in FIGS. 2, 6A, and 6B. The direction shown with arrow C is a direction perpendicular to rotation axis 11*a* of heating rotator 11 on a plane including rotation axis 11*a* of heating rotator 11 and rotation axis 10*a* of pressure roller 10.

(Separation Member)

Separation member 13 separates paper P which has passed through fixing nip region n2 from heating rotator 11. As a tip end of paper P which has passed through fixing nip region n2 comes in contact with separation member 13, paper P is separated from heating rotator 11.

(Magnetic Flux Generator)

Magnetic flux generator 12 is an apparatus which generates magnetic fluxes for having heat generation layer 113 of heating rotator 11 inductively generate heat. Magnetic flux generator 12 is arranged at a position outside the outer circumferential surface of heating rotator 11 and opposed to pressure roller 10 with heating rotator 11 being interposed. As shown in FIGS. 2 to 4, magnetic flux generator 12 includes a coil bobbin 121, an excitation coil 122, and cover 123.

Coil bobbin 121 is a plate-shaped member which is bent such that a cross-section thereof is substantially in a U shape and fixed to a not-shown frame of image forming apparatus 100.

Coil bobbin 121 is constituted of a first flat portion 121*a* located upstream from rotation axis 11*a* of heating rotator 11 in a direction of transportation of paper P, a second flat portion 121*b* located downstream from rotation axis 11*a* of heating rotator 11 in the direction of transportation of paper P, and a coupling portion 121*c* which couples first flat portion 121*a* and second flat portion 121*b* to each other.

First flat portion 121*a* and second flat portion 121*b* are substantially in parallel to the plane including rotation axis 11*a* of heating rotator 11 and rotation axis 10*a* of pressure roller 10. Coupling portion 121*c* is curved in an arc shape along the outer circumferential surface of heating rotator 11 and couples end surfaces of first flat portion 121*a* and second flat portion 121*b* opposite to transportation path R1 to each other.

A highly heat-resistant and insulating resin material is used for coil bobbin 121. For example, a liquid crystal polymer (LCP) is employed for coil bobbin 121 in order to lessen warpage caused by heat at the time when a fixing temperature is reached.

As shown in FIGS. 2 to 4, excitation coil 122 is structured such that conductive wires are wound around a surface of coil bobbin 121. As shown in FIGS. 3 and 4, a winding axis 122*a* of excitation coil 122 is orthogonal to rotation axis 11*a* of heating rotator 11 and rotation axis 10*a* of pressure roller 10. In other words, winding axis 122*a* of excitation coil 122 is located on the plane including rotation axis 11*a* of heating rotator 11 and rotation axis 10*a* of pressure roller 10 and perpendicular to rotation axis 11*a* of heating rotator 11 and rotation axis 10*a* of pressure roller 10.

Excitation coil 122 is connected to high-frequency power supply circuit 19 and supplied with high-frequency power from 100 W to 2000 W at 20 kHz to 90 kHz, and therefore a litz wire which is a bundle of several ten to several hundred thin wires covered with a heat-resistant resin is employed. A fused layer is formed as a surface layer of the litz wire. By heating and fusing and bonding the fused layer in winding and fixing excitation coil 122, excitation coil 122 maintains its coil shape and is fixed to coil bobbin 121.

Cover 123 is a member which covers a surface of coil bobbin 121 where excitation coil 122 is fixed. Similarly to coil bobbin 121, cover 123 is formed of a highly heat-resistant and insulating resin material.

Though not shown, a magnetic core is arranged between cover 123 and excitation coil 122. Thus, efficiency of a magnetic circuit between excitation coil 122 and heat generation layer 113 of heating rotator 11 is enhanced and leakage of magnetic fluxes to the outside of cover 123 is shielded. A material high in magnetic permeability and low in loss is employed for the material for the magnetic core. For example, such an alloy as ferrite and permalloy is desirable.

(Configuration Arranged Inside Heating Rotator)

As shown in FIG. 4, pressing member 16, first magnetic core 17, second magnetic core 18, and temperature sensor 25 are arranged inside heating rotator 11.

Pressing member 16 is a pad which presses heating rotator 11 against pressure roller 10 from the inside, and fixed to support member 14. Pressing member 16 has strength to such an extent as bearing a load applied by pressure roller 10 for fixing toner T on paper P. Therefore, pressing member 16 is composed of such a metal as iron, SUS, and aluminum.

First magnetic core 17 is arranged in the vicinity of pressing member 16 so as to cover a periphery of pressing member 16. First magnetic core 17 is fixed to support member 14. Specifically, first magnetic core 17 has a cross-section substantially in a U shape and covers a surface of pressing member 16 opposed to pressure roller 10 and surfaces of pressing member 16 upstream and downstream in the direction of transportation of paper P. First magnetic core 17 lies between pressing member 16 and heating rotator 11 in order to cover the surface of pressing member 16 opposed to pressure roller 10.

First magnetic core 17 is made of a ferrite core high in magnetic permeability. Thus, first magnetic core 17 can decrease magnetic fluxes which pass through pressing member 16. As described above, pressing member 16 is composed of a metal. Therefore, when the pressing member 16 receives magnetic fluxes, it generates heat owing to induction heating Since heat is less likely to conduct from pressing member 16 to paper P, heat generation by pressing member 16 leads to waste power consumption. By arranging first magnetic core 17 around pressing member 16, however, heat generation by pressing member 16 owing to magnetic fluxes generated by excitation coil 122 can be suppressed. Namely, heat generation by pressing member 16 which contributes less to heat conduction to paper P can be suppressed. Consequently, power can be concentrated to heat generation by heating rotator 11.

Second magnetic core 18 is arranged opposite to pressure roller 10 with respect to pressing member 16. In other words, second magnetic core 18 is arranged at a position closer to excitation coil 122 than pressing member 16 in the inside of heating rotator 11. Second magnetic core 18 is fixed to support member 14.

Second magnetic core 18 is made of a ferrite core high in magnetic permeability. Thus, second magnetic core 18 can attract magnetic fluxes generated by excitation coil 122. Consequently, magnetic fluxes which pass through heating rotator 11 increase and an amount of heat generation by heating rotator 11 can be increased.

Temperature sensor 25 is arranged inside heating rotator 11 and fixed to support member 14. Temperature sensor 25 is arranged at a position opposed to excitation coil 122 in the inside of heating rotator 11. Temperature sensor 25 is, for example, a contact temperature sensor, and it senses a temperature in the vicinity of heating rotator 11 and outputs the result to high-frequency power supply circuit 19.

(High-Frequency Power Supply Circuit)

High-frequency power supply circuit 19 is a circuit which feeds a current to excitation coil 122. High-frequency power supply circuit 19 outputs, for example, high-frequency power from 100 W to 2000 W at 20 kHz to 90 kHz to excitation coil 122. High-frequency power supply circuit 19 controls power to be output to excitation coil 122 such that a temperature sensed by temperature sensor 25 is closer to a target temperature.

(Movement Mechanism Which Moves Heating Rotator)

A movement mechanism which moves heating rotator 11 will now be described. The movement mechanism is constituted of the pair of guide members 15, 15, the pair of springs 21, 21, the pair of eccentric cams 22, 22, and motor 24 as described above.

As shown in FIGS. 2, 6A, and 6B, the pair of guide members 15, 15 slidably supports the pair of support members 14, 14 which supports the end portions of heating rotator 11.

Guide member 15 is constituted of a first flat portion 152 and a second flat portion 153 and fixed to a not-shown frame or the like of image forming apparatus 100.

First flat portion 152 is a plate-shaped member perpendicular to rotation axis 11*a* of heating rotator 11 and has an elongated hole 151 formed, with a direction shown with arrow C being defined as a longitudinal direction. Slide shaft portion 143 of support member 14 is inserted in elongated hole 151. A minor diameter of elongated hole 151 is slightly greater than a diameter of slide shaft portion 143. Therefore, first flat portion 152 restricts movement of slide shaft portion 143 in a direction of a short side of elongated hole 151 and slidably supports slide shaft portion 143 in the direction shown with arrow C.

Second flat portion 153 is a plate-shaped member which extends from the end portion of first flat portion 152 on a side of pressure roller 10 toward heating rotator 11 and is integrated with first flat portion 152. Second flat portion 153 is perpendicular to the longitudinal direction of elongated hole 151.

The pair of springs 21, 21 is provided in correspondence with the pair of guide members 15, 15. Spring 21 is arranged in a compressed state between second flat portion 153 of corresponding guide member 15 and slide shaft portion 143 inserted in elongated hole 151 in corresponding guide member 15. Therefore, spring 21 applies biasing force to slide shaft portion 143 in a direction away from pressure roller 10 (a direction shown with an arrow E in FIGS. 6A and 6B).

The pair of eccentric cams 22, 22 is provided in correspondence with the pair of guide members 15, 15. Eccentric cam 22 is provided such that its outer peripheral surface is in contact with a side of slide shaft portion 143 opposite to the side where spring 21 is arranged. A shaft 22*a* of eccentric cam 22 is rotatably supported by a bearing member provided in a not-shown frame of image forming apparatus 100. A position of shaft 22*a* of eccentric cam 22 is set such that a point on the outer peripheral surface of eccentric cam 22 most distant from shaft 22*a* is in contact with slide shaft portion 143 when slide shaft portion 143 is located at the end of elongated hole 151 on the side of pressure roller 10.

Motor 24 rotates shaft 22*a* of eccentric cam 22 in response to an instruction from controller 26.

(Controller)

Controller 26 controls operations of each part of image forming apparatus 100. Details of control of fixing apparatus 20 by controller 26 will be described later.

Controller 26 is implemented by a central processing unit (CPU) which executes various programs including an OS, a read only memory (ROM) which stores various types of data, a random access memory (RAM) which provides a work area for storing data necessary for execution of a program by the CPU, and a hard disk (HDD) which stores in a non-volatile manner, a program executed by the CPU.

(Movement of Heating Rotator by Movement Mechanism)

Movement of heating rotator 11 by the movement mechanism will now be described with reference to FIGS. 6A and 6B. FIG. 6A shows a state of fixing apparatus 20 when the point on the outer peripheral surface of eccentric cam 22 most distant from shaft 22*a* is in contact with slide shaft portion 143. Slide shaft portion 143 is pushed toward the end of elongated hole 151 on the side of pressure roller 10 by eccentric cam 22 against biasing force from spring 21. Heating rotator 11 supported by support member 14 including slide shaft portion 143 is thus in contact with pressure roller 10.

When eccentric cam 22 rotates from the state shown in FIG. 6A, slide shaft portion 143 moves in the direction away from pressure roller 10 in accordance with biasing force from spring 21. FIG. 6B shows a state of fixing apparatus 20 when eccentric cam 22 rotates by 180 degrees. Slide shaft portion 143 reaches the end of elongated hole 151 opposite to pressure roller 10.

By thus rotating eccentric cam 22, heating rotator 11 supported by support member 14 including slide shaft portion 143 can be moved along the direction shown with arrow C.

As described above, the direction shown with arrow C is a direction perpendicular to rotation axis 11*a* of heating rotator 11 on the plane including rotation axis 11*a* of heating rotator 11 and rotation axis 10*a* of pressure roller 10. Therefore, the direction shown with arrow C is in parallel to winding axis 122*a* of excitation coil 122. Therefore, the movement mechanism can be concluded to move heating rotator 11 along winding axis 122*a* of excitation coil 122.

(Details of Control of Fixing Apparatus)

Figure 7:
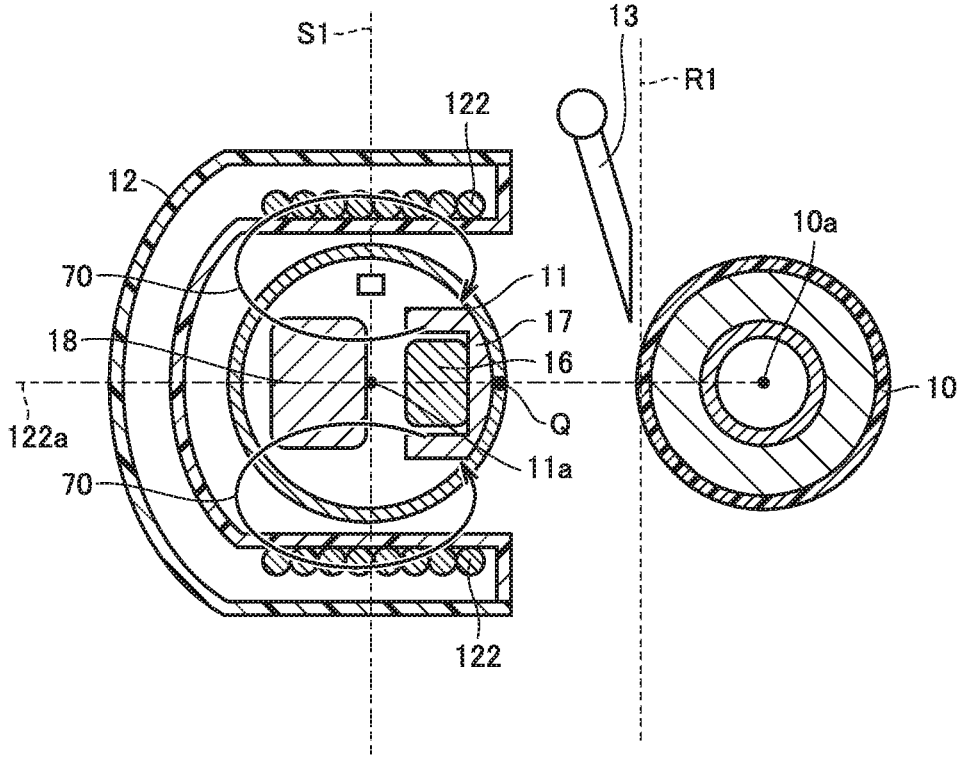
FIG. 7 is a cross-sectional view of the fixing apparatus according to the first embodiment in a preheating mode.

Details of control of fixing apparatus 20 by controller 26 will be described with reference to FIGS. 4, 6A. 6B, and 7. FIG. 7 is a cross-sectional view of the fixing apparatus when heating rotator 11 is located at a position shown in FIG. 6B. FIG. 4 shows a cross-sectional view of the fixing apparatus when heating rotator 11 is located at a position shown in FIG. 6A. A relative position of heating rotator 11 and excitation coil 122 shown in FIG. 4 is referred to as a first relative position and a relative position of heating rotator 11 and excitation coil 122 shown in FIG. 7 is referred to as a second relative position.

Controller 26 controls fixing apparatus 20 in accordance with any of a fixing mode, a preheating mode, and a stand-by mode. Controller 26 controls fixing apparatus 20 in accordance with the fixing mode during a period from reception of an instruction for printing until completion of printing. Controller 26 controls fixing apparatus 20 in accordance with the preheating mode during a period immediately after start-up of image forming apparatus 100 until lapse of a prescribed time period and during a period from completion of printing until lapse of a prescribed time period Controller 26 controls fixing apparatus 20 in accordance with the stand-by mode after the end of the preheating mode when there is no instruction for printing during control in the preheating mode.

In the fixing mode, controller 26 controls motor 24 to move heating rotator 11 so as to set heating rotator 11 and excitation coil 122 to the first relative position (see FIG. 4) and rotates pressure roller 10 at a prescribed process speed. Furthermore, controller 26 controls high-frequency power supply circuit 19 such that a temperature sensed by temperature sensor 25 is within a range of prescribed fixing temperatures.

When heating rotator 11 and excitation coil 122 are located at the first relative position, heating rotator 11 and pressure roller 10 are in contact with each other. Therefore, by rotating pressure roller 10, heating rotator 11 rotates as following the rotation.

A plane perpendicular to the plane including rotation axis 11*a* of heating rotator 11 and rotation axis 10*a* of pressure roller 10 and including rotation axis 11*a* of heating rotator 11 is defined as a plane S1 (see FIG. 4). Plane S1 is in parallel to the direction of transportation of paper P.

As shown in FIG. 4, in the fixing mode, excitation coil 122 covers a semicircular portion of heating rotator 11 on the side of magnetic flux generator 12 relative to plane S1. When viewed in the direction of transportation of paper P, excitation coil 122 is not superimposed on first magnetic core 17 and pressing member 16 but is superimposed on second magnetic core 18. Therefore, magnetic fluxes generated by excitation coil 122 are attracted toward second magnetic core 18 and pass through the semicircular portion of heating rotator 11 on the side of magnetic flux generator 12 relative to plane S1. FIG. 4 shows magnetic field lines 70 which represent some of magnetic fluxes generated by excitation coil 122.

Since magnetic fluxes from excitation coil 122 pass through only a half region of heating rotator 11, a temperature of heating rotator 11 is uneven if heating rotator 11 is not rotating. In the fixing mode, however, heating rotator 11 rotates as following rotation of pressure roller 10, and hence heating rotator 11 can uniformly be heated.

In the preheating mode, controller 26 controls motor 24 to move heating rotator 11 so as to set heating rotator 11 and excitation coil 122 to the second relative position (see FIG. 7) and stops rotation of pressure roller 10. Furthermore, controller 26 controls high-frequency power supply circuit 19 such that a temperature sensed by temperature sensor 25 is within a range of prescribed preheating temperatures (a temperature lower than the range of the fixing temperatures).

FIGS. 6B and 7 show fixing apparatus 20 controlled in accordance with the preheating mode. When heating rotator 11 and excitation coil 122 are located at the second relative position as shown in FIGS. 6B and 7, as compared with when they are located at the first relative position, excitation coil 122 is closer to a point Q in heating rotator 11 closest to rotation axis 10*a* of pressure roller 10. Specifically, excitation coil 122 is located at a position substantially in symmetry with respect to plane S1 and covers substantially the entire outer circumferential surface of heating rotator 11. Magnetic fluxes generated by excitation coil 122 thus pass through substantially the entire circumferential region of heating rotator 11. Consequently, heating rotator 11 can uniformly be heated without rotating heating rotator 11. In other words, unevenness in temperature in heating rotator 11 can be suppressed.

When heating rotator 11 and excitation coil 122 are located at the second relative position, heating rotator 11 has been moved away from pressure roller 10. Since heat does not escape from heating rotator 11 to pressure roller 10, heating rotator 11 can efficiently be heated. Consequently, time required for setting a temperature of heating rotator 11 to be within the range of the preheating temperatures is shorter Since rotation of pressure roller 10 is stopped, power consumption can be reduced.

In the stand-by mode, controller 26 controls motor 24 such that heating rotator 11 and excitation coil 122 are located at the second relative position and stops rotation of pressure roller 10. Furthermore, controller 26 stops supply of power from high-frequency power supply circuit 19 to magnetic flux generator 12. Thus, heating of heating rotator 11 is stopped and power consumption can further be reduced.

Controller 26 may continue control in the fixing mode for a prescribed time period in consideration of the possibility of successive reception of instructions for printing after completion of printing. Controller 26 may carry out control in accordance with the fixing mode also when a toner image is not being fixed to paper P. In other words, controller 26 does not always carry out control in accordance with the preheating mode or the stand-by mode when a toner image is not being fixed to paper P, but should only carry out control in accordance with the preheating mode after the end of the fixing mode.

(Advantages)

As set forth above, fixing apparatus 20 includes heating rotator 11 which generates heat with an induced current, excitation coil 122 arranged outside heating rotator 11, and pressure roller 10 which rotates with paper P being held between the pressure roller and heating rotator 11, the paper having a toner image developed thereon. Fixing apparatus 20 further includes the movement mechanism (relative position changer) which changes a relative position of heating rotator 11 and excitation coil 122 to the first relative position in the fixing mode in which a toner image is being fixed to paper P and to the second relative position in the preheating mode in which a toner image is not being fixed to paper P. A distance from point Q in heating rotator 11 closest to pressure roller 10 to excitation coil 122 is shorter at the second relative position than at the first relative position.

The movement mechanism is constituted of the pair of guide members 15, 15, the pair of springs 21, 21, the pair of eccentric cams 22, 22, and motor 24.

Point Q in heating rotator 11 closest to rotation axis 10*a* of the pressure roller is in contact with paper P in the fixing mode. Therefore, in the fixing mode, magnetic flux generator 12 cannot be arranged around point Q because of interference with transportation path R1 for paper P and a portion around point Q in heating rotator 11 cannot be heated. Therefore, when the relative position of heating rotator 11 and excitation coil 122 is not changed in the fixing mode and the preheating mode, heating rotator 11 should be rotated even in the preheating mode in order to suppress unevenness in temperature in heating rotator 11.

In fixing apparatus 20 in the first embodiment, however, the relative position of heating rotator 11 and excitation coil 122 is changed such that a distance from point Q to excitation coil 122 is shorter in the preheating mode than in the fixing mode. Thus, in the preheating mode, a portion around point Q can also be heated. Consequently, unevenness in temperature during induction heating of heating rotator 11 can be suppressed even when heating rotator 11 is not rotating or rotating at a low speed.

Heating rotator 11 is an endless belt. Fixing apparatus 20 further includes first magnetic core 17 and second magnetic core 18 which are arranged inside heating rotator 11 and higher in magnetic permeability than heating rotator 11.

Magnetic fluxes generated by excitation coil 122 can thus be attracted to the inside of heating rotator 11. Consequently, magnetic fluxes which pass through heating rotator 11 can be increased and heating rotator 11 can efficiently be heated.

Fixing apparatus 20 includes pressing member 16 which presses heating rotator 11 against pressure roller 10 in the inside of heating rotator 11. First magnetic core 17 covers pressing member 16.

Thus, magnetic fluxes generated by excitation coil 122 are attracted to first magnetic core 17 and magnetic fluxes which pass through pressing member 16 are decreased. Consequently, pressing member 16 made of a metal is not inductively heated and waste power consumption can be suppressed.

Second magnetic core 18 is arranged opposite to pressure roller 10 with respect to pressing member 16. As described above, in the fixing mode, magnetic flux generator 12 cannot be arranged around point Q due to interference with transportation path R1 for paper P. Therefore, in the fixing mode, magnetic flux generator 12 is arranged to cover heating rotator 11 in a region where it does not interfere with transportation path R1 for paper P, that is, a region far from pressure roller 10. Therefore, by arranging second magnetic core 18 opposite to pressure roller 10 with respect to pressing member 16, magnetic fluxes generated by excitation coil 122 are more likely to be attracted toward heating rotator 11. Consequently, heating rotator 11 can efficiently be heated.

Specifically, when viewed in the direction of transportation of paper P, excitation coil 122 is superimposed on second magnetic core 18 and not superimposed on first magnetic core 17 when heating rotator 11 and excitation coil 122 are located at the first relative position. Excitation coil 122 is superimposed on first magnetic core 17 and second magnetic core 18 when heating rotator 11 and excitation coil 122 are located at the second relative position.

Thus, when heating rotator 1 and excitation coil 122 are located at the second relative position, that is, in the preheating mode, magnetic fluxes generated by excitation coil 122 are more likely to be attracted toward heating rotator 11 by first magnetic core 17 and second magnetic core 18. Consequently, magnetic fluxes which pass through heating rotator 11 can further be increased and heating rotator 11 can efficiently be heated.

When heating rotator 11 and excitation coil 122 are located at the second relative position, heating rotator 11 is not in contact with pressure roller 10 and does not rotate. Thus, in the preheating mode, vibration noise resulting from rotation of pressure roller 10 and heating rotator 11 is not produced and operation noise of image forming apparatus 100 when it is not performing printing can be lowered.

As heating rotator 11 and pressure roller 10 are distant from each other, heat conduction from heating rotator 11 to pressure roller 10 and heat radiation to the surroundings through pressure roller 10 are suppressed and time required for healing heating rotator 10 to a range of prescribed preheating temperatures can be shorter.

Fixing apparatus 20 further includes temperature sensor 25 arranged inside heating rotator 11 and high-frequency power supply circuit 19 which controls power supplied to excitation coil 122 in accordance with a temperature sensed by temperature sensor 25. A temperature of heating rotator 11 is thus accurately sensed. A temperature of heating rotator 11 can be maintained within a target temperature range in accordance with the sensed temperature.

Winding axis 122*a* of excitation coil 122 is orthogonal to rotation axis 11*a* of heating rotator 11 and rotation axis 10*a* of pressure roller 10. The movement mechanism changes a relative position of excitation coil 122 and heating rotator 11 by moving heating rotator 11 along winding axis 122*a* of excitation coil 122. Thus, the relative position of excitation coil 122 and heating rotator 11 can readily be changed simply by sliding heating rotator 11.

(Modification)

The movement mechanism which moves heating rotator 11 is not limited to the configuration above. For example, the movement mechanism which moves heating rotator 11 may be constituted of a rack and pinion.

Second Embodiment

Figure 8A:
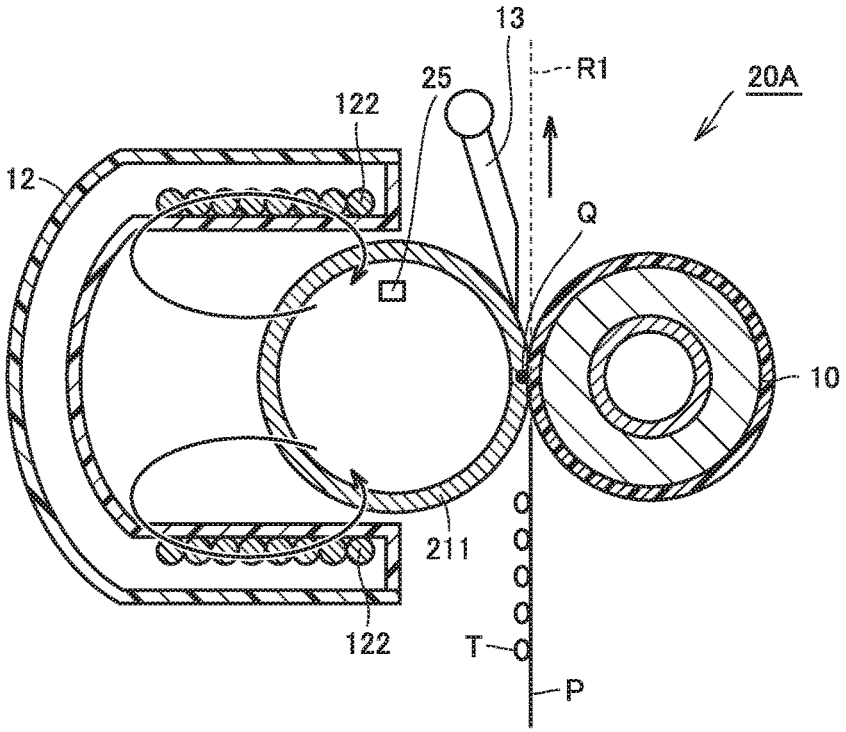
FIG. 8A is a cross-sectional view showing a fixing apparatus (in a fixing mode) according to a second embodiment.

A fixing apparatus according to a second embodiment of the present disclosure will be described with reference to FIGS. 8A and 8B. FIG. 8A is a cross-sectional view showing a fixing apparatus 20A (in the fixing mode) according to the second embodiment FIG. 8B is a cross-sectional view showing fixing apparatus 20A (in the preheating mode) according to the second embodiment.

Figure 8B:
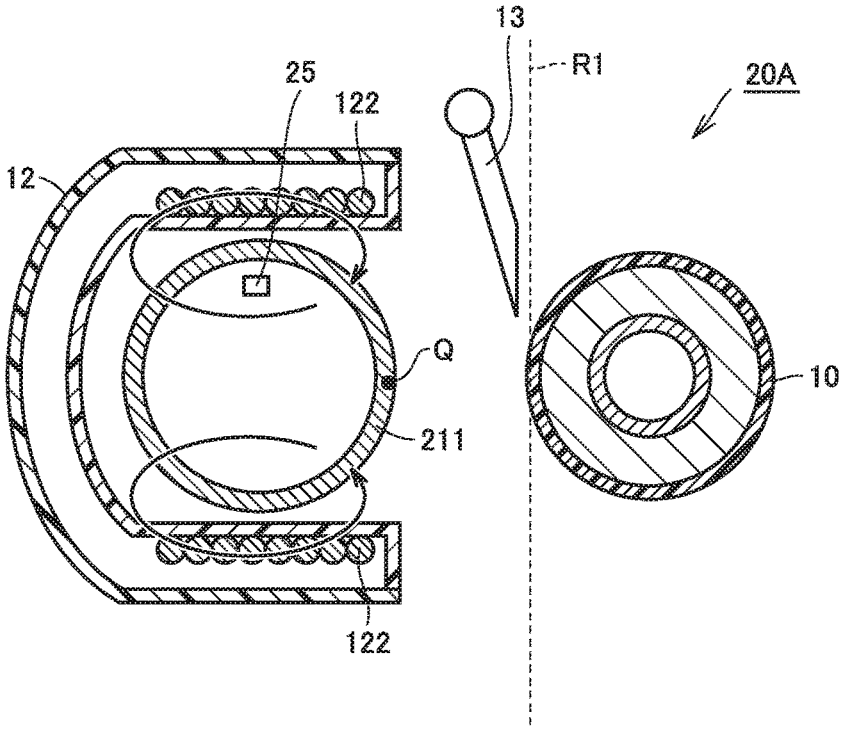
FIG. 8B is a cross-sectional view showing the fixing apparatus (in the preheating mode) according to the second embodiment.

As shown in FIGS. 8A and 8B, fixing apparatus 20A is different from fixing apparatus 20 according to the first embodiment only in including a heating rotator 211 instead of heating rotator 1I and not including pressing member 16, first magnetic core 17, and second magnetic core 18 in the inside of heating rotator 211.

Heating rotator 211 is a cylindrical metal roller (cylinder) which is greater in thickness than heating rotator 11 and has sufficient strength. Therefore, it is not necessary to provide pressing member 16 inside heating rotator 211. Heating rotator 211 is composed, for example, of iron, and heating rotator 211 has a thickness, for example, approximately from 0.7 to 1 mm.

Since heating rotator 211 is a metal roller, an induced current tends to be generated therein by magnetic fluxes generated by excitation coil 122 and the heating rotator 211 is readily heated. Since heating rotator 211 is greater in thickness than heating rotator 211 in the first embodiment, it is higher in heat conductivity than heating rotator 11. Therefore, without a magnetic core in the inside of heating rotator 211, heating rotator 211 can uniformly be heated in the preheating mode by moving heating rotator 211 as in the first embodiment Consequently, in the preheating mode, unevenness in temperature of heating rotator 211 can be lessened without rotating heating rotator 211.

Since heating rotator 211 is a metal roller, a pressure in a nip region between pressure roller 10 and heating rotator 211 is higher than in the first embodiment. When a color toner image formed with a plurality of types of toner is fixed to paper P, the toner image is preferably pressed against paper P at a relatively low pressure. Therefore, fixing apparatus 20A according to the second embodiment is suitable for an image forming apparatus which forms only a monochrome image, not for an image forming apparatus which forms a color image by using a plurality of types of toner.

Third Embodiment

Figure 9:
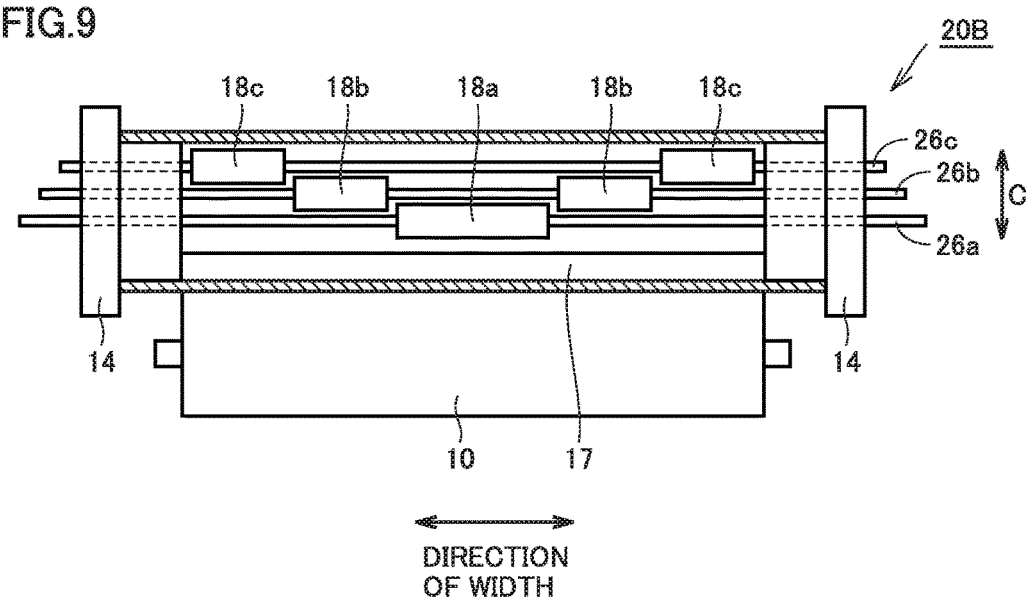
FIG. 9 is a cross-sectional view showing an internal configuration of a heating rotator of a fixing apparatus according to a third embodiment.
Figure 10A:
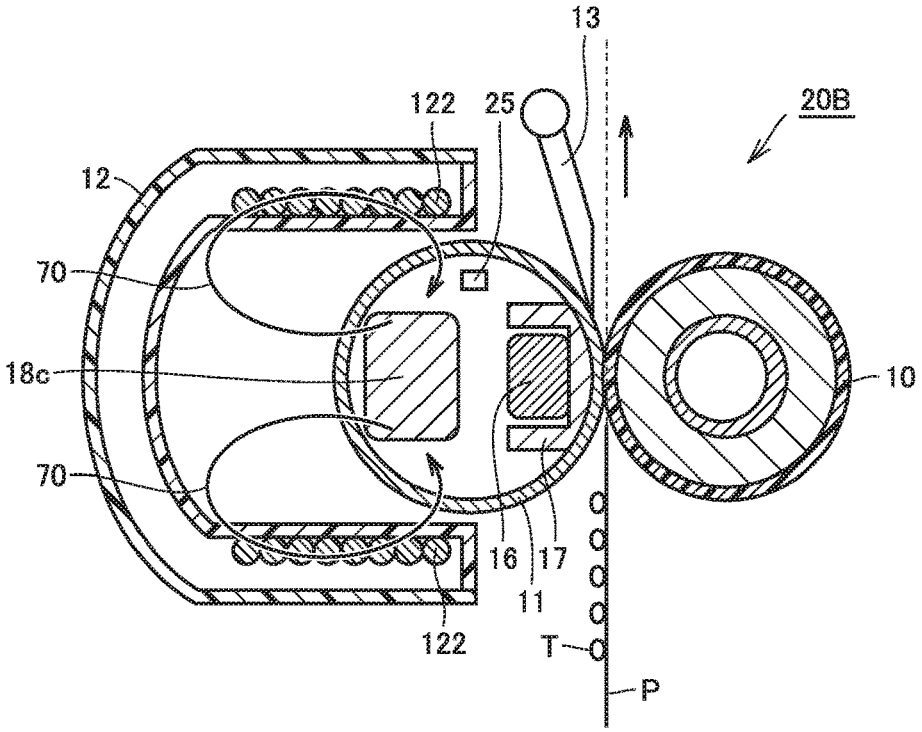
FIG. 10A is a cross-sectional view showing the fixing apparatus according to the third embodiment.
Figure 10B:
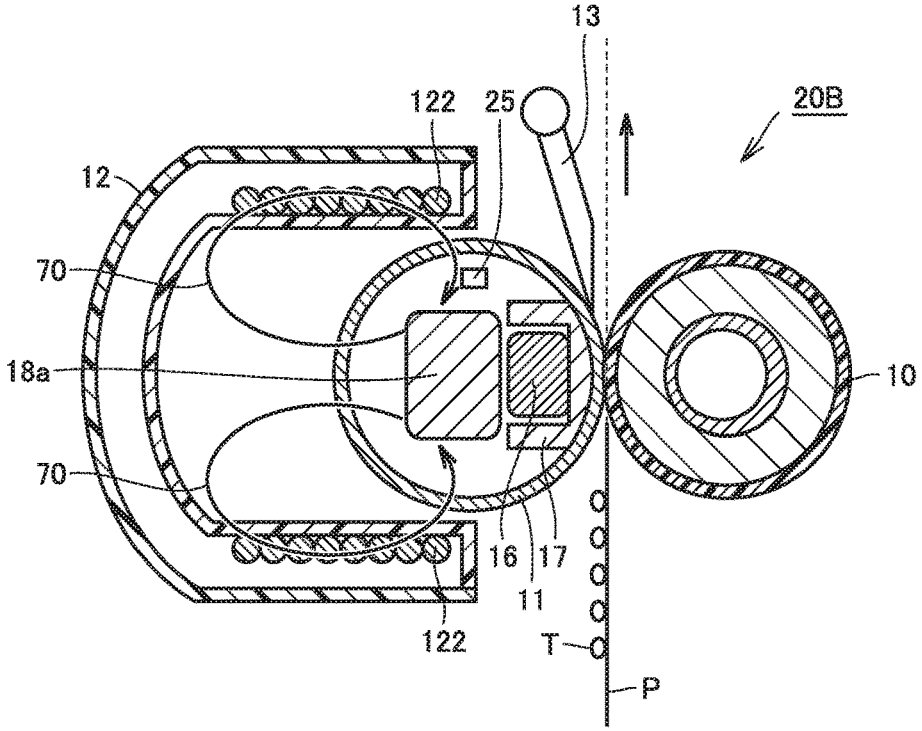
FIG. 10B is another cross-sectional view showing the fixing apparatus according to the third embodiment.

A fixing apparatus according to a third embodiment of the present disclosure will be described with reference to FIGS. 9, 10A, and 10B. FIG. 9 is a cross-sectional view showing an internal configuration of heating rotator 11 of a fixing apparatus 20B according to the third embodiment. FIGS. 10A and 10B are cross-sectional views showing fixing apparatus 20B according to the third embodiment. FIG. 10A shows a cross-sectional view at a position of a magnetic core 18*c* shown in FIG. 9 and FIG. 10B shows a cross-sectional view at a position of a magnetic core 18*a* shown in FIG. 9.

As shown in FIG. 9, fixing apparatus 20B according to the third embodiment is different from fixing apparatus 20 according to the first embodiment in including magnetic cores 18*a* to 18*c* instead of second magnetic core 18 and including support rods 26*a* to 26*c* connected to respective magnetic cores 18*a* to 18*c* in the inside of heating rotator 11.

Magnetic core 18*a* is arranged in a central portion in a direction of width of paper P in the inside of heating rotator 11. Magnetic core 18*a* is supported by support rod 26*a*. A pair of magnetic cores 18*b* is arranged on outer sides of one end and the other end of magnetic core 18*a* in the direction of width of paper P. Magnetic core 18*b* is supported by support rod 26*b*. A pair of magnetic cores 18*c* is arranged on further outer sides of the pair of magnetic cores 18*b*. Magnetic core 18*c* is supported by support rod 26*c*. Magnetic core 18*c*, magnetic core 18*b*, magnetic core 18*a*, magnetic core 18*b*, and magnetic core 18*c* are arranged in this order along the direction of width of paper P in the inside of heating rotator 11.

Support rods 26*a* to 26*c* are slidable along the direction shown with arrow C. Support rod 26*a* is bent as appropriate so as not to interfere with magnetic cores 18*b* and 18*c* when it is slid. Similarly, support rod 26*b* is bent as appropriate so as not to interfere with magnetic cores 18*a* and 18*c* when it is slid. Support rod 26*c* is bent as appropriate so as not to interfere with magnetic cores 18*a* and 18*b* when it is slid.

The movement mechanism which moves support rods 26*a* to 26*c* is not particularly limited, and for example, it is configured similarly to the movement mechanism which moves heating rotator 11.

In the fixing mode, controller 26 controls positions of magnetic cores 18*a* to 18*c* in accordance with a size of transported paper P. Specifically, controller 26 moves a magnetic core which is located at a position superimposed on paper P to come closer to pressure roller 10. In contrast, controller 26 moves a magnetic core which is located at a position not superimposed on paper P away from the pressure roller 10.

FIGS. 10A and 10B show cross-sectional views of fixing apparatus 20B when paper P is superimposed on magnetic cores 18*a* and 18*b* but is not superimposed on magnetic core 18*c*. As shown in FIG. 10A, controller 26 moves magnetic core 18*c* away from pressure roller 10. In contrast, as shown in FIG. 10B, controller 26 moves magnetic core 18*a* toward pressure roller 10. Controller 26 moves also magnetic core 18*b* toward pressure roller 10 similarly to magnetic core 18*a*.

In a region where paper P passes, heat escapes from heating rotator 11 to paper P and a temperature thereof tends to lower. Magnetic fluxes generated by excitation coil 122 tend to concentrate in magnetic cores 18*a* and 18*b* high in magnetic permeability. Therefore, by moving magnetic cores 18*a* and 18*b* superimposed on paper P toward pressure roller 10, magnetic fluxes which pass through heating rotator 11 increase. Namely, magnetic coupling between excitation coil 122 and heating rotator 11 is stronger. Consequently, efficiency m heat generation of heating rotator 11 is enhanced. Even when heat escapes to paper P, a temperature of heating rotator 11 can be maintained within a prescribed temperature range.

In contrast, in a region where paper P does not pass, heat tends to be stored in heating rotator 11 and a temperature of the heating rotator tends to be high. When the temperature is too high, release layer 111 and elastic layer 112 which form heating rotator 11 tend to deteriorate. By moving magnetic core 18*c* not superimposed on paper P away from pressure roller 10, magnetic fluxes which pass through heating rotator 11 decrease. Consequently, an amount of heat generation in heating rotator 11 decreases and heating rotator 11 can be prevented from excessively increasing in temperature.

Thus, in fixing apparatus 20B, magnetic cores 18*a* to 18*c* can move in the inside of heating rotator 11. Thus, magnetic fluxes which pass through heating rotator 11 can be modified and an amount of heat generation in heating rotator 11 can be adjusted as appropriate.

Though magnetic cores 18*a* to 18*c* are moved in the description above, first magnetic core 17 may also be moved together.

Fourth Embodiment

Figure 11:
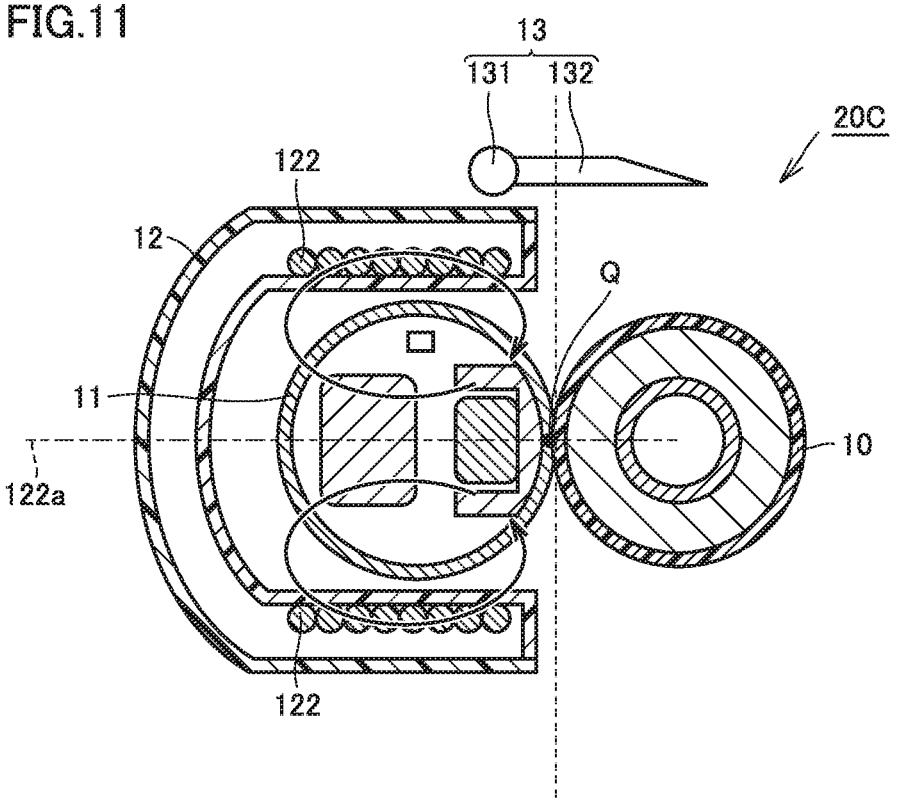
FIG. 11 is a cross-sectional view showing a fixing apparatus according to a fourth embodiment in the preheating mode.

A fixing apparatus according to a fourth embodiment of the present disclosure will be described with reference to FIG. 11. FIG. 11 is a cross-sectional view showing a fixing apparatus 20C according to the fourth embodiment in the preheating mode.

Fixing apparatus 20C according to the fourth embodiment is different from fixing apparatus 20 according to the first embodiment in that a relative position of heating rotator 11 and excitation coil 122 is changed between the fixing mode and the preheating mode by moving magnetic flux generator 12 instead of heating rotator 11. Fixing apparatus 20C according to the fourth embodiment includes a movement mechanism which moves magnetic flux generator 12 instead of the movement mechanism which moves heating rotator 11 (guide member 15, eccentric cam 22, spring 21, and motor 24).

In fixing apparatus 20C, separation member 13 includes a separation tab 132 having a tip end in contact with the surface of heating rotator 11 and a pivot portion 131 which pivotably supports separation tab 132.

For example, a configuration similar to the movement mechanism which moves heating rotator 11 should only be employed as the movement mechanism which moves magnetic flux generator 12. Namely, a shaft portion integrated with magnetic flux generator 12, a guide member which slidably supports the shaft portion, a spring which applies biasing force to the shaft portion, an eccentric cam which abuts on the shaft portion and slides the shaft portion against the biasing force from the spring, and a motor which rotates the eccentric cam should only form the movement mechanism which moves magnetic flux generator 12. The movement mechanism which moves magnetic flux generator 12 is not limited thereto, and it may be constituted, for example, of a rack and pinion.

In the fourth embodiment as well, a relative position of heating rotator 11 and excitation coil 122 in the fixing mode is as shown in FIG. 4. Heating rotator 11 is inductively heated by magnetic fluxes from excitation coil 122 while heating rotator 11 is rotated. Heating rotator 11 is thus uniformly heated.

As shown in FIG. 11, in the preheating mode, controller 26 moves magnetic flux generator 12 along winding axis 122*a* of excitation coil 122 toward heating rotator 11. The relative position of heating rotator 11 and excitation coil 122 is thus the same as the second relative position in the first embodiment shown in FIG. 7. Thus, even when rotation of heating rotator 11 is stopped or a rotation speed is lowered, unevenness in temperature in heating rotator 11 can be suppressed.

A position of separation member 13 in the fixing mode (see FIG. 4) and a position of magnetic flux generator 12 in the preheating mode (see FIG. 11) are superimposed on each other. Therefore, controller 26 moves separation member 13 so as not to interfere with magnetic flux generator 12 in the preheating mode. Specifically, controller 26 pivots separation tab 132 around pivot portion 131.

As set forth above, in fixing apparatus 20C, a relative position of excitation coil 122 and heating rotator 11 is changed by moving excitation coil 122. Therefore, pressure roller 10 remains in contact with heating rotator 11 also in the preheating mode. As described above, in the preheating mode, unevenness in temperature in heating rotator 11 can be suppressed also when rotation of heating rotator 11 is stopped or when a rotation speed is lowered. Therefore, the rotation speed of pressure roller 10 in the preheating mode can be lower than the rotation speed of pressure roller 10 in the fixing mode. The rotation speed of pressure roller 10 in the preheating mode may be set to 0.

In fixing apparatus 20C, separation member 13 is movable to a position shown in FIG. 4 when heating rotator 11 and excitation coil 122 are located at the first relative position and to a position shown in FIG. 11 when heating rotator 11 and excitation coil 122 are located at the second relative position. Thus, magnetic flux generator 12 can be moved in the preheating mode to a position where separation member 13 was present in the fixing mode (see FIG. 4). Consequently, in the preheating mode, excitation coil 122 can cover a wider region of the outer circumference of heating rotator 11.

(Modification)

Figure 12:
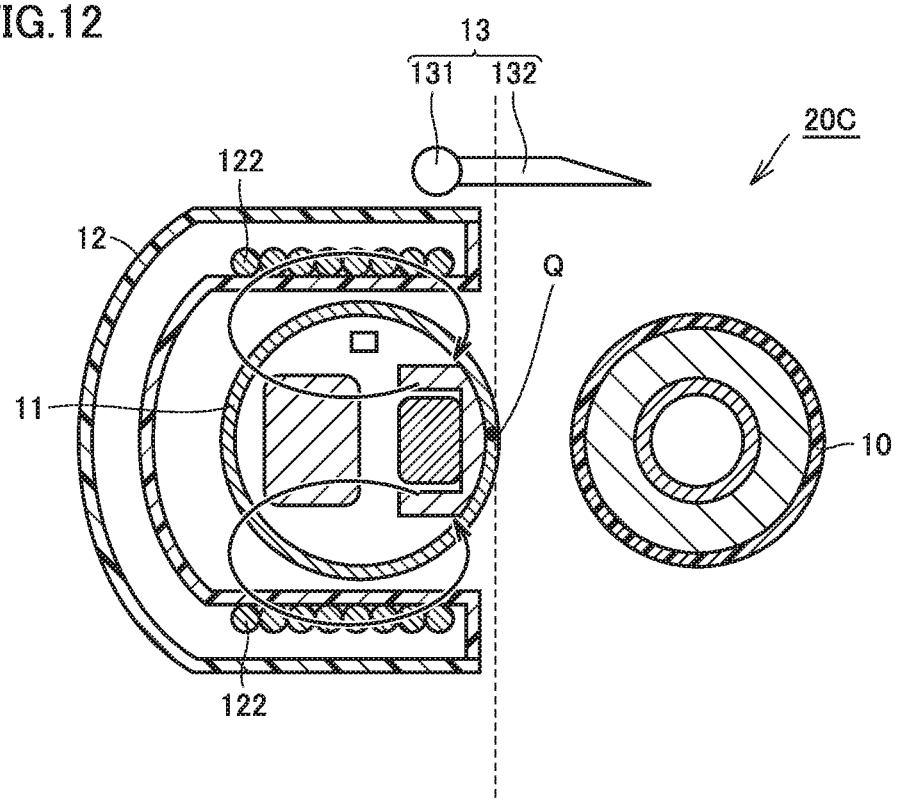
FIG. 12 is a cross-sectional view showing the fixing apparatus according to a modification in the preheating mode.

A modification of fixing apparatus 20C according to the fourth embodiment will be described with reference to FIG. 12. FIG. 12 is a cross-sectional view showing fixing apparatus 20C according to the modification in the preheating mode.

As described above, in the preheating mode, the relative position of heating rotator 11 and excitation coil 122 is the same as the second relative position in the first embodiment shown in FIG. 7. Unevenness in temperature in heating rotator 11 can thus be suppressed. Therefore, it is not necessary to rotate heating rotator 1 in the preheating mode.

As shown in FIG. 12, controller 26 moves pressure roller 10 away from heating rotator 11 in the preheating mode. Thus, heat no longer conducts from heating rotator 11 to pressure roller 10 and heating rotator 11 can efficiently be heated. Consequently, power consumption can be reduced.

In this case, fixing apparatus 20C further includes a movement mechanism which moves pressure roller 10. The movement mechanism which moves pressure roller 10 is provided, for example, by a configuration similar to the movement mechanism which moves heating rotator 11 or a rack and pinion.

A relative position of heating rotator 11 and excitation coil 122 may be changed by moving not only magnetic flux generator 12 but also heating rotator 11.

Fifth Embodiment

Figure 13:
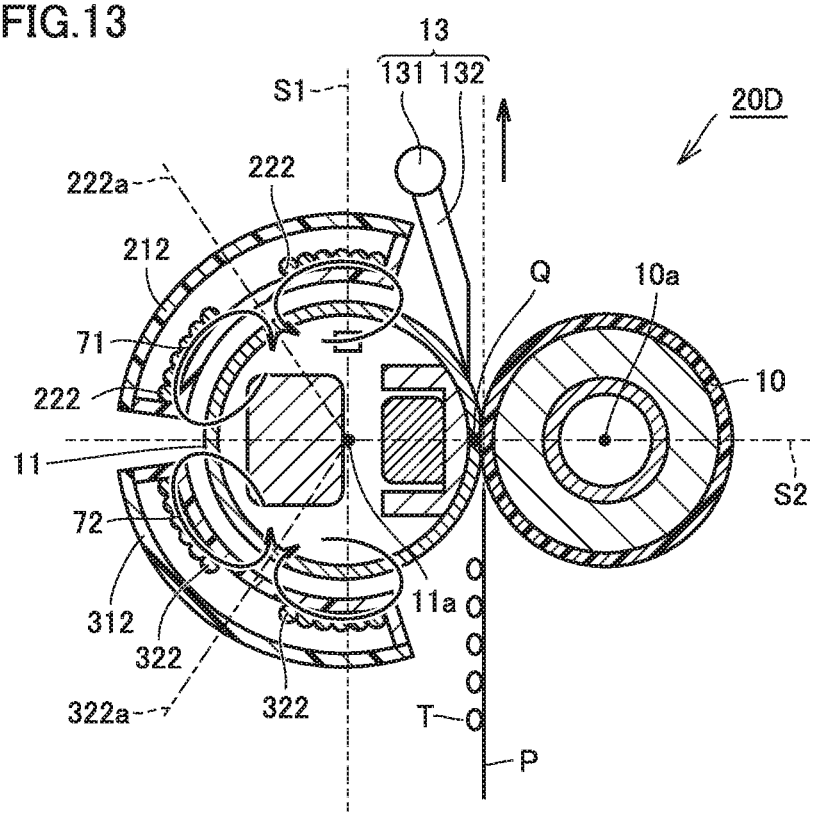
FIG. 13 is a cross-sectional view showing a fixing apparatus in a fifth embodiment in the fixing mode.
Figure 14:
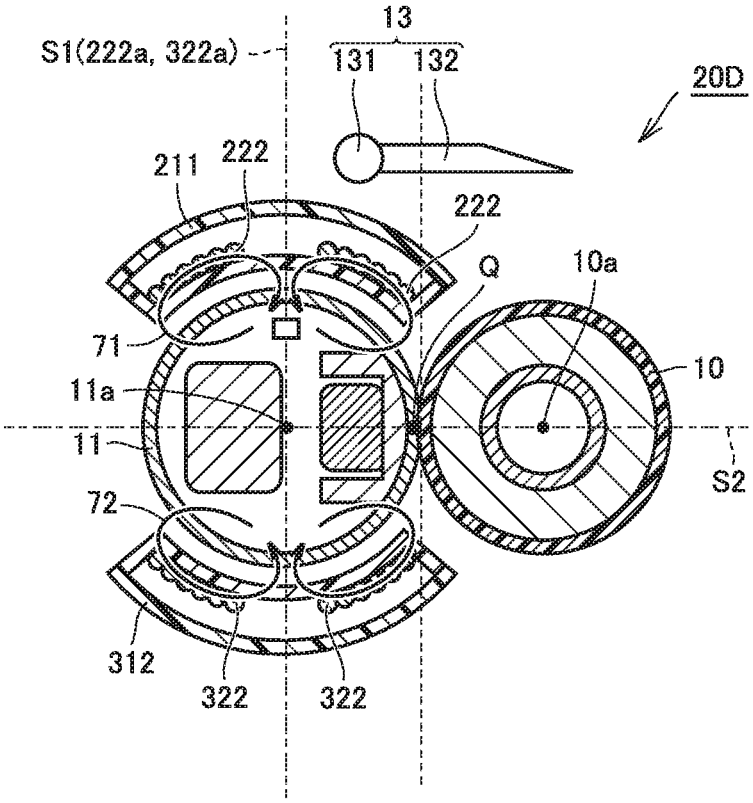
FIG. 14 is a cross-sectional view showing the fixing apparatus according to the fifth embodiment in the preheating mode.
Figure 15:
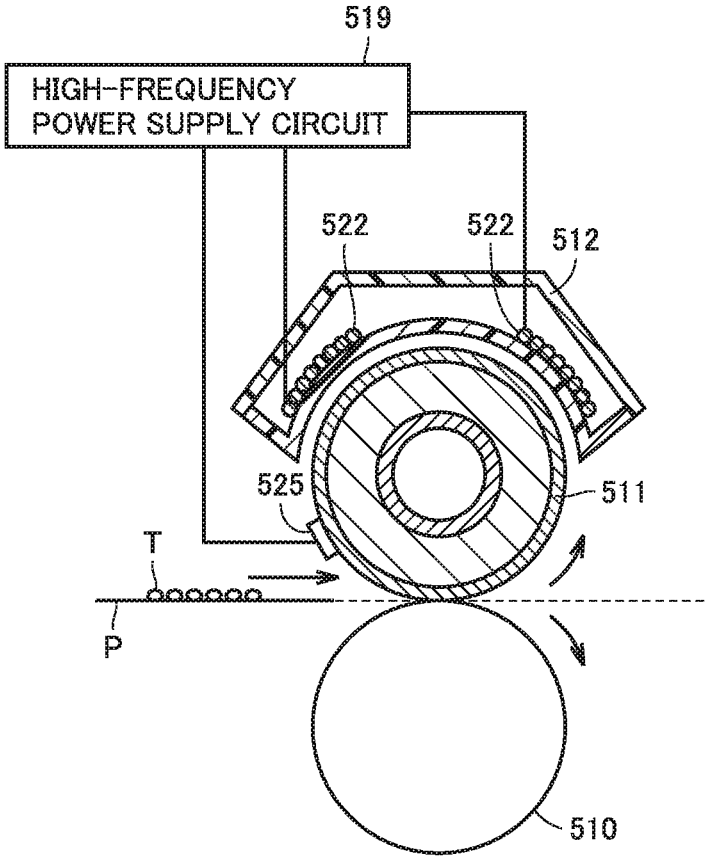
FIG.15 PRIOR ART
FIG. 15 is a cross-sectional view showing a conventional example of a fixing apparatus.

A fixing apparatus 20D according to a fifth embodiment of the present disclosure will be described with reference to FIGS. 13 and 14. FIG. 13 is a cross-sectional view showing fixing apparatus 20D in the fixing mode. FIG. 14 is a cross-sectional view showing fixing apparatus 20D in the preheating mode.

As shown in FIGS. 13 and 14, fixing apparatus 20D is different from fixing apparatus 20 in the first embodiment in including magnetic flux generators 212 and 312 instead of magnetic flux generator 12.

Magnetic flux generator 212 is arranged downstream from a plane S2 including rotation axis 11*a* of heating rotator 11 and rotation axis 10*a* of pressure roller 10 in the direction of transportation of paper P. Magnetic flux generator 212 has a cross-section in a shape of an are along the outer circumferential surface of heating rotator 11.

An excitation coil 222 is accommodated in magnetic flux generator 212 and generates magnetic fluxes which pass through heating rotator 11. FIGS. 13 and 14 show magnetic field lines 71 which represent some of magnetic fluxes generated by excitation coil 222. A winding axis 222*a* of excitation coil 222 is orthogonal to the rotation axis of heating rotator 11.

Magnetic flux generator 312 is arranged upstream from plane S2 in the direction of transportation of paper P. Magnetic flux generator 312 has a cross-section in a shape of an arc along the outer circumferential surface of heating rotator 11.

An excitation coil 322 is accommodated in magnetic flux generator 312 and generates magnetic fluxes which pass through heating rotator 11. FIGS. 13 and 14 show magnetic field lines 72 which represent some of magnetic fluxes generated by excitation coil 322. A winding axis 322*a* of excitation coil 322 is orthogonal to the rotation axis of heating rotator 11.

As shown in FIG. 13, in the fixing mode, magnetic flux generator 212 is arranged such that the center of excitation coil 222 is located opposite to pressure roller 10 with respect to plane S1. Similarly, in the fixing mode, magnetic flux generator 312 is arranged such that the center of excitation coil 322 is located opposite to pressure roller 10 with respect to plane S1.

In the fixing mode, excitation coils 222 and 322 intensively heat a part of heating rotator 11 opposite to pressure roller 10 with respect to plane S1. Since heating rotator 11 rotates together with pressure roller 10, it is uniformly heated.

In the preheating mode shown in FIG. 14, magnetic flux generator 212 rotationally moves around rotation axis 11*a* of heating rotator 11 such that excitation coil 222 comes closer to point Q in heating rotator 11 closest to pressure roller 10. Specifically, magnetic flux generator 212 rotationally moves to a position where excitation coil 222 is substantially in symmetry with respect to plane S1. Winding axis 222*a* of excitation coil 222 is located on plane S1.

Similarly, magnetic flux generator 312 rotationally moves around rotation axis 11*a* of heating rotator 11 such that excitation coil 322 comes closer to point Q. Specifically, magnetic flux generator 312 rotationally moves to a position where excitation coil 322 is substantially in symmetry with respect to plane S1. Winding axis 322*a* of excitation coil 122 is located on plane S1.

Thus, in the preheating mode, heating rotator 11 is uniformly inductively heated by excitation coils 222 and 322. Consequently, unevenness in temperature in heating rotator 11 can be suppressed even when rotation of heating rotator 11 is stopped or when a rotation speed is lowered.

Various known mechanisms can be employed as the movement mechanism which rotationally moves magnetic flux generator 212 and magnetic flux generator 312. For example, the movement mechanism includes a pair of discs which is rotatable around rotation axis 11*a* of heating rotator 11 and a motor which rotates the pair of discs in directions opposite to each other, and magnetic flux generators 212 and 312 are supported by the pair of discs, respectively. Magnetic flux generator 212 and magnetic flux generator 312 can thus readily rotationally be moved.

A position of separation member 13 in the fixing mode (see FIG. 13) and a position of magnetic flux generator 212 in the preheating mode (sec FIG. 14) arc superimposed on each other. Therefore, controller 26 moves separation member 13 so as not to interfere with magnetic flux generator 212 in the preheating mode. Specifically, controller 26 pivots separation tab 132 around pivot portion 131 as in the fourth embodiment.

As set forth above, fixing apparatus 20D includes excitation coil (first excitation coil) 222 of which winding axis 222*a* is orthogonal to rotation axis 11*a* of heating rotator 11 and excitation coil (second excitation coil) 322 of which winding axis 322*a* is orthogonal to rotation axis 11*a* of heating rotator 11. By rotationally moving excitation coils 222 and 322 around rotation axis 11*a* of heating rotator 11, a relative position of excitation coils 222 and 322 and heating rotator 11 is changed. In the fixing mode, heating rotator 11 and excitation coils 222 and 322 are located at the relative position (first relative position) shown in FIG. 13, and in the preheating mode, heating rotator 11 and excitation coils 222 and 322 are located the relative position (second relative position) shown in FIG. 14. Thus, unevenness in temperature in heating rotator 11 can be suppressed in the preheating mode even when rotation of heating rotator 11 is stopped or when a rotation speed is lowered.

As in the modification of the fourth embodiment, pressure roller 10 may be moved away from heating rotator 11 in the preheating mode.

As set forth above, a fixing apparatus according to one aspect of the present disclosure includes a heating rotator which generates heat with an induced current an excitation coil arranged outside the heating rotator, a pressure roller which rotates with paper being held between the pressure roller and the heating rotator, the paper having a toner image developed thereon, and a relative position changer which changes a relative position of the excitation coil and the heating rotator to a first relative position when the toner image is being fixed to the paper and to a second relative position when the toner image is not being fixed to the paper. In a cross-section perpendicular to a rotation axis of the heating rotator, a distance from a point in an outer circumferential surface of the heating rotator closest to the pressure roller to the excitation coil is shorter at the second relative position than at the first relative position.

Preferably, the heating rotator is an endless belt. The fixing apparatus further includes at least one magnetic core which is arranged inside the heating rotator and is higher in magnetic permeability than the heating rotator.

Preferably, the fixing apparatus further includes a pressing member in the heating rotator, which presses the heating rotator against the pressure roller. The at least one magnetic core includes a first magnetic core which covers the pressing member.

Preferably, the at least one magnetic core includes a second magnetic core arranged opposite to the pressure roller with respect to the pressing member.

Preferably, the at least one magnetic core is movable in the heating rotator.

Preferably, when viewed in a direction of transportation of the paper, the excitation coil is superimposed on the second magnetic core and is not superimposed on the first magnetic core when the excitation coil and the heating rotator are located at the first relative position, and is superimposed on the first magnetic core and the second magnetic core when the excitation coil and the heating rotator are located at the second relative position.

Preferably, a rotation speed of the heating rotator when the excitation coil and the heating rotator are located at the second relative position is 0 or lower than a rotation speed of the heating rotator when the excitation coil and the heating rotator are located at the first relative position.

Preferably, the relative position changer changes the relative position of the excitation coil and the heating rotator by moving the heating rotator.

Preferably, the relative position changer changes the relative position of the excitation coil and the heating rotator by moving the excitation coil.

Preferably, the fixing apparatus further includes a separation member which separates the paper from the heating rotator. The separation member is movable to a first position when the excitation coil and the heating rotator are located at the first relative position and to a second position when the excitation coil and the heating rotator are located at the second relative position.

Preferably, the pressure roller moves away from the heating rotator when the excitation coil and the heating rotator are located at the second relative position.

Preferably, the excitation coil has a winding axis orthogonal to the rotation axis of the heating rotator and a rotation axis of the pressure roller. The relative position changer changes the relative position of the excitation coil and the heating rotator by moving at least one of the excitation coil and the heating rotator along the winding axis.

Preferably, the fixing apparatus includes as the excitation coil, first and second excitation coils of which winding axes are orthogonal to the rotation axis of the heating rotator. The relative position changer changes the relative position of the excitation coil and the heating rotator by rotationally moving at least one of the first and second excitation coils around the rotation axis of the heating rotator.

Preferably, the heating rotator is an endless belt or a cylinder. The fixing apparatus further includes a temperature sensor arranged inside the heating rotator and a power supply circuit which controls power supplied to the excitation coil in accordance with a temperature sensed by the temperature sensor.

According to another aspect, an image forming apparatus includes the fixing apparatus described above.

Although embodiments of the present invention have been described and illustrated in detail, it is clearly understood that the same is by way of illustration and example only and not limitation, the scope of the present invention should be interpreted by terms of the appended claims.

What is claimed is:

1. A fixing apparatus comprising:

a heating rotator which generates heat with an induced current;

an excitation coil arranged outside the heating rotator, a pressure roller which rotates with paper being held between the pressure roller and the heating rotator, the paper having a toner image developed thereon; and a relative position changer which changes a relative position of the excitation coil and the heating rotator to a first relative position when the toner image is being fixed to the paper and to a second relative position when the toner image is not being fixed to the paper, in a cross-section perpendicular to a rotation axis of the heating rotator, a distance from a point closest to the pressure roller in an outer circumferential surface of the heating rotator to the excitation coil being shorter at the second relative position than at the first relative position.

2. The fixing apparatus according to claim 1, wherein the hearing rotator is an endless belt, and the fixing apparatus further comprises at least one magnetic core which is arranged in inside of the heating rotator and is higher in magnetic permeability than the heating rotator.

3. The fixing apparatus according to claim 2, the fixing apparatus further comprising a pressing member which is arranged in the inside of the heating rotator and presses the heating rotator against the pressure roller, wherein the at least one magnetic core includes a first magnetic core which covers the pressing member.

4. The fixing apparatus according to claim 3, wherein the at least one magnetic core includes a second magnetic core arranged opposite to the pressure roller with respect to the pressing member.

5. The fixing apparatus according to claim 2, wherein the at least one magnetic core is movable in the inside of the heating rotator.

6. The fixing apparatus according to claim 4, wherein when viewed in a direction of transportation of the paper, the excitation coil is superimposed on the second magnetic core and is not superimposed on the first magnetic core when the excitation coil and the heating rotator are located at the first relative position, and is superimposed on the first magnetic core and the second magnetic core when the excitation coil and the heating rotator are located at the second relative position.

7. The fixing apparatus according to claim 1, wherein a rotation speed of the heating rotator when the excitation coil and the heating rotator are located at the second relative position is 0 or lower than a rotation speed of the heating rotator when the excitation coil and the heating rotator are located at the first relative position.

8. The fixing apparatus according to claim 1, wherein the relative position changer changes the relative position of the excitation coil and the heating rotator by moving the heating rotator.

9. The fixing apparatus according to claim 1, wherein the relative position changer changes the relative position of the excitation coil and the heating rotator by moving the excitation coil.

10. The fixing apparatus according to claim 9, the fixing apparatus further comprising a separation member which separates the paper from the heating rotator, wherein the separation member is movable to a first position when the excitation coil and the heating rotator are located at the first relative position and to a second position when the excitation coil and the heating rotator are located at the second relative position.

11. The fixing apparatus according to claim 9, wherein the pressure roller moves away from the heating rotator when the excitation coil and the heating rotator are located at the second relative position.

12. The fixing apparatus according to claim 1, wherein the excitation coil has a winding axis orthogonal to the rotation axis of the heating rotator and a rotation axis of the pressure roller, and the relative position changer changes the relative position of the excitation coil and the heating rotator by moving at least one of the excitation coil and the heating rotator along the winding axis.

13. The fixing apparatus according to claim 9, the fixing apparatus comprising as the excitation coil, first and second excitation coils of which winding axes are orthogonal to the rotation axis of the heating rotator, wherein the relative position changer changes the relative position of the excitation coil and the heating rotator by rotationally moving at least one of the first and second excitation coils around the rotation axis of the heating rotator.

14. The fixing apparatus according to claim 1, wherein the heating rotator is an endless belt or a cylinder, and the fixing apparatus further comprises a temperature sensor arranged inside the heating rotator and a power supply circuit which controls electric power supplied to the excitation coil in accordance with a temperature sensed by the temperature sensor.

15. An image forming apparatus comprising the fixing apparatus according to claim 1.

* * * * *